US006378413B1

(12) United States Patent
Hoxie

(10) Patent No.: US 6,378,413 B1
(45) Date of Patent: Apr. 30, 2002

(54) BENT AXIS PISTON UNIT WITH ANGLED PISTON SOCKETS

(75) Inventor: Benjamin M. Hoxie, Hopkins, MN (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/694,137

(22) Filed: Oct. 23, 2000

(51) Int. Cl.[7] ..... F01B 3/00
(52) U.S. Cl. ..... 92/12.2; 92/71
(58) Field of Search ..... 92/12.2, 57, 71

(56) References Cited

U.S. PATENT DOCUMENTS

| | | | | |
|---|---|---|---|---|
| 3,760,692 A | | 9/1973 | Molly | 91/505 |
| 3,793,924 A | | 2/1974 | Eickmann | 91/487 |
| 3,827,337 A | * | 8/1974 | Pruvot | 91/489 |
| 4,991,492 A | * | 2/1991 | Bratt et al. | 92/71 |
| 5,488,894 A | | 2/1996 | Schroder | 91/505 |

* cited by examiner

*Primary Examiner*—F. Daniel Lopez
*Assistant Examiner*—Thomas E. Lazo
(74) *Attorney, Agent, or Firm*—L. J. Kasper

(57) ABSTRACT

An axial piston device (11) of the bent axis type including a housing (13), a main shaft (29) defining an axis of rotation (A), a cylinder barrel (37) defining a plurality of mutually parallel cylinders (39), and a piston (45) reciprocably disposed in each cylinder (39). The cylinder barrel is mounted to be pivotable within the housing relative to the axis of rotation (A). A universal type connection (35) is operable to transmit rotational movement between the main shaft (29) and the cylinder barrel as the cylinder barrel pivots through its range of motion between a minimum displacement and a maximum displacement (FIG. 2) relative to the axis of rotation (A). A plurality of connecting rods (49) is arranged to correspond generally to the cylinders, each connecting rod including a ball portion (51) pivotably received within a socket member (55) fixed relative to the main shaft (29). Each socket member (55) defines an axis (61), each axis being oriented outwardly at an acute angle relative to the axis of rotation (A), thus permitting an increase in the maximum stroke angle (FIG. 3) of the cylinder barrel relative to the axis of rotation.

7 Claims, 3 Drawing Sheets

BENT AXIS PISTON UNIT WITH ANGLED PISTON SOCKETS

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to an axial piston hydraulic device of the bent axis type, and more particularly, to such a device of the type in which the input-output shaft ("main" shaft) defines socket members for receiving the forward ends of piston connecting rods.

As used herein, the term "axial piston" will be understood by those skilled in the art to mean and include a hydraulic device in which pistons reciprocate within a rotatable cylinder barrel, the axes of the pistons being at least generally mutually parallel. Furthermore, references herein and in the appended claims to an axial piston device will be understood to mean and include such devices which are used as both motors and pumps.

An axial piston pump or motor of the "bent axis" type is one in which the axis of the input-output shaft is coaxial with the axis of rotation of the cylinder barrel only when the device is in its zero displacement condition. Achieving a positive displacement condition involves pivoting the entire rotating group (i.e., the cylinder barrel, pistons, connecting rods, etc.) so that the axis of rotation of the rotating group defines some acute angle relative to the axis of rotation of the input-output shaft. As is well know to those skilled in the art, the greater the angle of displacement of the rotating group, the larger the output flow per revolution of the input-output shaft (assuming the device is being used as a pump).

In many applications for axial piston pumps and motors, the bent axis type is preferred because the range of stroke angles is much greater in a bent axis device than in an "in-line" axial piston device (i.e., one in which the axes of the shaft and the rotating group remain coaxial, and displacement is varied by tilting a tiltable swashplate). By way of example, the typical maximum displacement for commercially available in-line axial piston devices is in the range of about twenty degrees, whereas bent axis piston devices frequently operate at maximum displacements in the range of about forty-five degrees.

As is well known to those skilled in the art, the leakage area of an axial piston device is fairly constant, such that as stroke angle increases, the amount of leakage per unit volume decreases. Therefore, the higher the stroke angle, the greater the overall efficiency of the device. As a result, many of those skilled in the art are constantly seeking design improvements which will permit an increase in the maximum possible stroke angle of bent axis axial piston devices, which also permits a greater range of flows for a given unit size.

In some relatively lower performance bent axis axial piston devices, the balls at the forward ends of the piston connecting rods are merely received within hemispherical openings in the flange of the input-output shaft. However, in relatively higher performance devices, such as where the operating pressure is relatively higher, or the unit is operating at a greater speed, or there is a desire for a greater overall efficiency, each of the connecting rod balls is received within a socket member disposed in the flange of the input-output shaft. As a result, the flange of the input-output shaft can be selected for characteristics such as overall fatigue strength, whereas the socket member can be selected for characteristics which are important in regard to the engagement between the connecting rod ball and the socket member.

BRIEF SUMMARY OF THE INVENTION

Accordingly, it is an object of the present invention to provide an axial piston device of the bent axis type which is able to achieve a greater maximum stroke angle than was possible with the prior art devices.

It is a more specific object of the present invention to provide such an improved axial piston device of the type which utilizes socket members for receiving the ball portions of the piston connecting rods.

The above and other objects of the invention are accomplished by the provision of an axial piston device of the bent axis type comprising a housing, a main shaft rotatably supported relative to the housing, and defining an axis of rotation. A cylinder barrel is rotatably disposed within the housing, the cylinder barrel defining a plurality of mutually parallel cylinders, a piston reciprocably disposed in each cylinder for axial displacement therein, and the cylinder barrel being mounted to be pivotable within the housing relative to the axis of rotation. A universal type connection is operable to transmit rotational movement between the main shaft and the cylinder barrel as the cylinder barrel pivots through its range of motion between a minimum displacement and a maximum displacement relative to the axis of rotation. A plurality of connecting rods is arranged to correspond generally to the cylinders, each connecting rod having a pivotable connection to one of the pistons and including a ball portion pivotably received within a socket member fixed relative to the main shaft.

The improved axial piston device is characterized by each of the socket members defining an axis, each axis being oriented outwardly at an acute angle relative to the axis of rotation of the main shaft, thus permitting an increase in the maximum displacement of the cylinder barrel relative to the axis of rotation.

DETAILED DESCRIPTION OF THE PREFERRED EMBODIMENT

Figure 1:
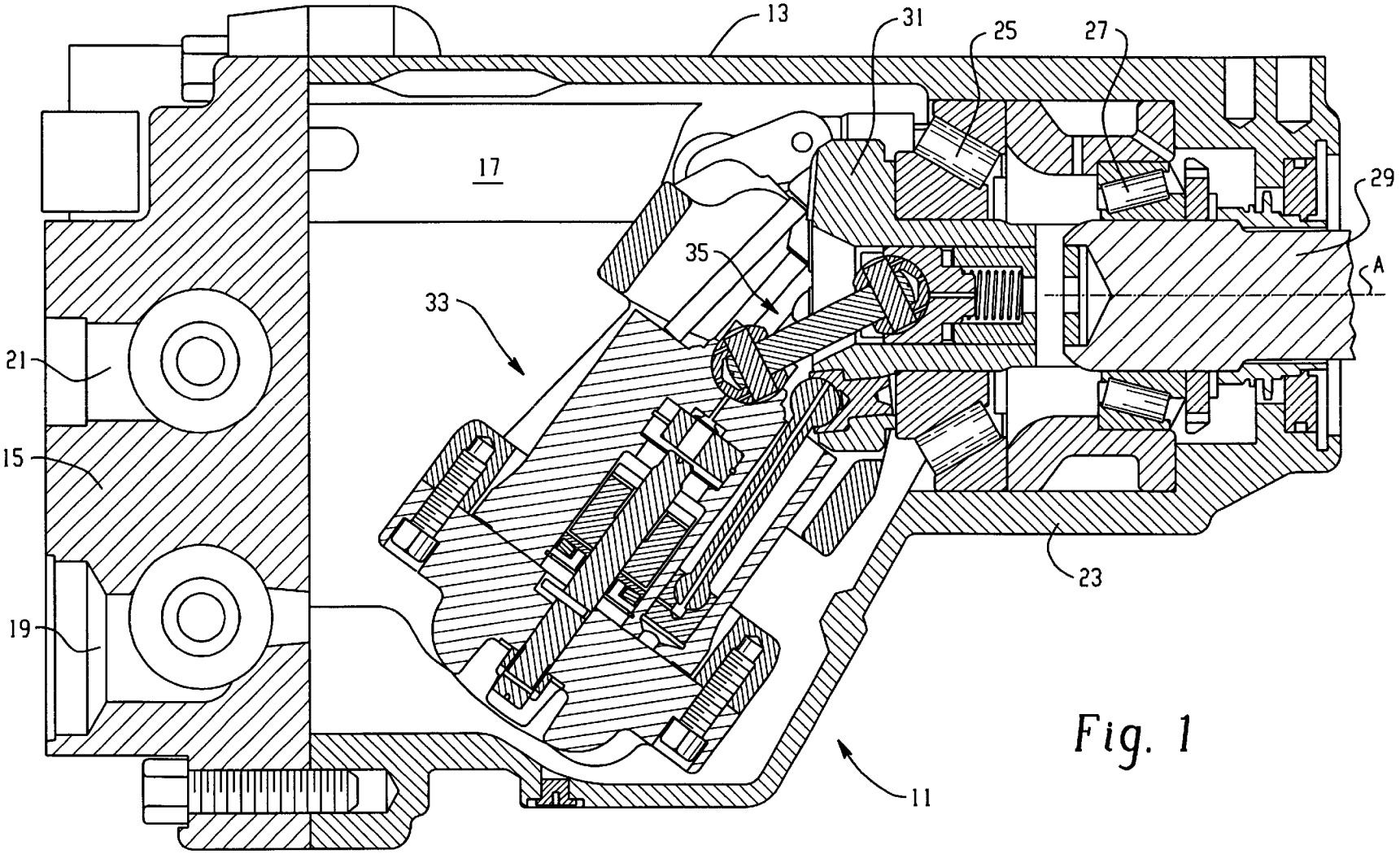
FIG. 1 is an axial cross-section of a bent axis axial piston device made in accordance with the present invention, the device being shown in its maximum displacement condition.

Referring now to the drawings, which are not intended to limit the invention, FIG. 1 illustrates an axial piston device, generally designated 11, of the bent axis type, which is generally well known to those skilled in the art, has been in commercial use for a number of years, and will be described in detail only to the extent necessary to describe the present invention.

The axial piston device 11 includes a housing 13 which cooperates with an end cap 15 to define therein a pumping chamber 17. As is shown only in FIG. 1, the end cap 15 defines a pair of fluid ports 19 and 21, one of which would serve as a fluid inlet port, while the other would serve as a fluid outlet port. As is well known, when the device is being used as a pump, reversing the direction of rotation of the main shaft will reverse which port serves as the inlet and which serves as the outlet. When the device is being used as a motor, reversing which port serves as the inlet and which port serves as the outlet will reverse the resulting direction of rotation of the main shaft.

Disposed toward a forward end (right end in FIG. 1) of the housing 13 is a cylindrical, forward housing portion 23, and disposed therein is a pair of tapered roller bearing sets 25 and 27. Rotatably supported relative to the forward housing portion 23 by the bearing sets 25 and 27 is an input-output (main) shaft 29. If the device 11 were to be used exclusively as a pump, the shaft 29 would comprise only an input shaft, whereas if the device 11 were to be used exclusively as a motor, the shaft 29 would comprise only an output shaft. However, the subject embodiment of the device 11 is a device which is used as a pump-motor unit, i.e., the unit functions as a pump under certain conditions and as a motor under other conditions. Thus, the shaft 29 is referred to as an "input-output" shaft.

The rearward end (left end in FIG. 1) of the shaft 29 includes a flange portion 31. Disposed within the pumping chamber 17 is a rotating group, generally designated 33 which, in FIG. 1, is shown in its maximum displacement condition. The rotating group 33 is connected to the input-output shaft 29 by means of a universal connection, generally designated 35. Those skilled in the art should understand that the details of the construction of the universal connection 35 form no essential part of the present invention, except to the extent that the universal connection design selected must be one which is capable of permitting the present invention to achieve its full potential, i.e., permitting the largest possible displacement of the axis of the rotating group 33 relative to an axis of rotation A of the input-output shaft 29. Universal connections are readily available commercially which can achieve the above-stated object. If the rotating group 33 were to rotate clockwise from the position shown in FIG. 1 until the rotational axis of the rotating group 33 would be co-axial with the axis of rotation A of the shaft 29, such would constitute the minimum displacement condition of the rotating group 33. In the minimum displacement condition, there is substantially zero flow output from the device (when being used as a pump) per revolution of the shaft 29.

Figure 2:
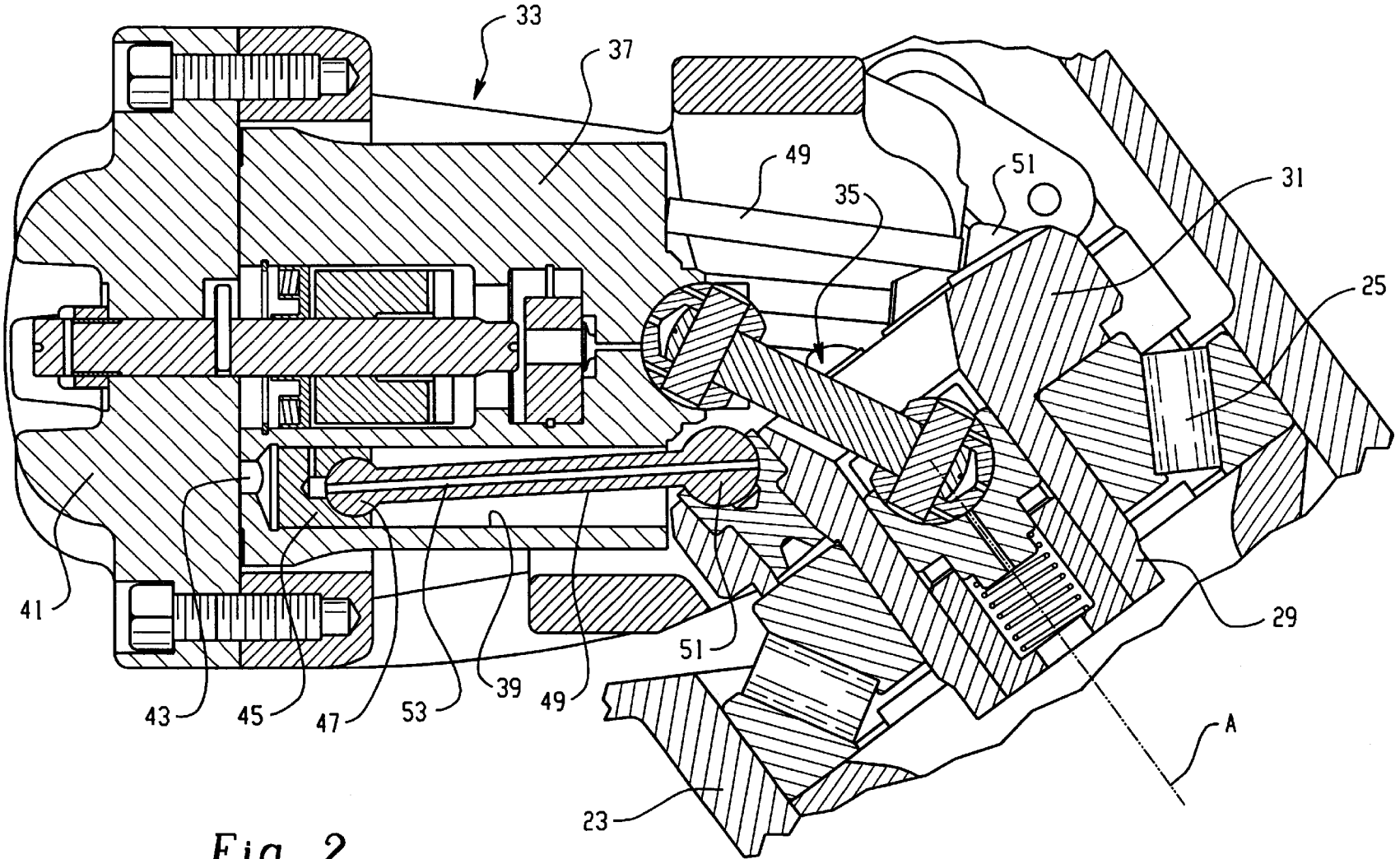
FIG. 2 is an enlarged, fragmentary axial cross-section, similar to FIG. 1, showing primarily the rotating group and its connection to the flange portion of the input-output shaft.

Referring now primarily to FIG. 2, the rotating group 33 will be described in further detail. The rotating group 33 includes a cylinder barrel 37 which defines a plurality of mutually parallel cylinders 39. However, it is well known to those skilled in the axial piston pump-motor art to orient the cylinders at an acute angle relative to the axis of rotation of the cylinder barrel 37, and such an arrangement is included herein within the definition of "axial piston". Disposed at the rearward end of the cylinder barrel 37 (the left end in FIG. 2) there is an end plate 41, held in tight, fluid sealing engagement with the adjacent end surface of the cylinder barrel 37. Each cylinder 39 terminates, at its rearward end adjacent the end plate 41, in a fluid port 43. In a manner well know to those skilled in the art, each of the ports 43 is in communication with one of the fluid ports 19 or 21, as the cylinder barrel 37 rotates.

Disposed in each of the cylinders 39 for reciprocation therein is a piston member 45. Each piston member 45 defines a generally hemispherical recess which receives a rearward ball portion 47 of a connecting rod 49. Each connecting rod 49 also includes a forward ball portion 51. In a manner well know to those skilled in the art, but not essential to the present invention, each of the connecting rods 49 defines an axially extending fluid passage 53, operable to communicate pressurized fluid for lubrication purposes from a pressurized chamber defined by the piston member 45. The lubrication fluid which flows through the fluid passage 53 serves to lubricate the outer surface of the forward ball portion 51 as it pivots relative to a socket member 55 (see FIG. 3). Each socket member 55 is received within a generally cylindrical, stepped bore 56 formed in the flange portion 31.

In the subject embodiment, and by way of example only, each of the socket members 55 is made from a bronze alloy suitable for pivotal engagement, under load, with the ball portion 51, while maintaining good wear characteristics. Preferably, the pivot center of the ball portion 51, designated "57" herein, is offset to be axially forward, about a distance "D", of a plane 59 which contains the apex point (not specifically illustrated herein) at which the axis of rotation A of the shaft 29 intersects the axis of rotation of the cylinder barrel 37. It has been found that the above-described offset relationship is helpful in being able to increase the maximum angle of displacement of the device.

Figure 3:
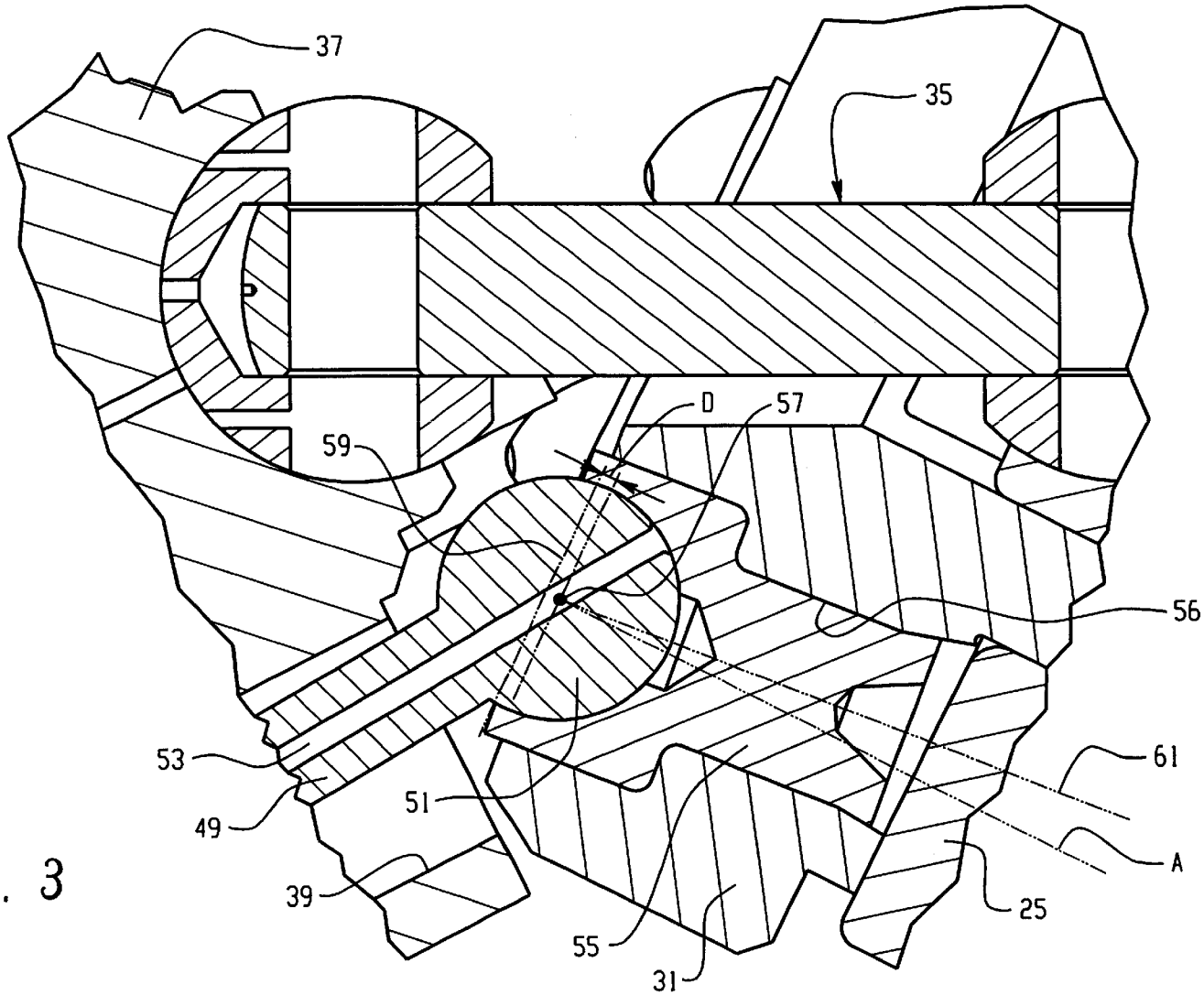
FIG. 3 is a further enlarged, fragmentary axial cross-section showing in greater detail the present invention.

In accordance with an important aspect of the invention, and as may best be seen in FIG. 3, each of the socket members 55 defines an axis 61 which is oriented at an outward angle relative to the axis of rotation A of the main shaft 29, as represented in FIG. 3 by the axis line A (which is parallel to the axis of rotation A of the main shaft 29). In the subject embodiment, and by way of example only, the axis 61 of the socket member 55, and the axis line A cooperate to define an included angle in the range of about four degrees to about eight degrees, and specifically in FIG. 3, about six degrees. Those skilled in the art will understand, from a reading and understanding of this specification, that the specific angle between the axis 61 and the axis line A will depend upon the particular design of the axial piston device 11.

It has been found, in connection with the development of the present invention, that orienting the socket members 55 outward as shown in FIG. 3 permits a greater maximum angle of displacement of the rotating group 33 then would be possible if the socket member were to remain parallel to the axis of rotation A of the main shaft 29. Thus, utilizing the present invention has been found to facilitate a maximum displacement in the range of about forty-five to about sixty degrees. It should be understood that it is only as each piston 45 and its connecting rod 49 reaches the "Top Dead Center" position shown in FIG. 3 (with the piston member 45 in its fully retracted ("fall in") position), that the angled socket member 55 provides a benefit, in terms of permitting greater stroke angle of the device, and therefore, a greater efficiency as described previously.

In the subject embodiment of the invention, it has been found that the maximum angle for the axes 61 of the socket members 55 is about six degrees. Any greater angle for the axes 61 would result in interference between each connecting rod 49 and its socket member 55, at the Bottom Dead Center position, i.e., the position of the connecting rod 49 at the top of FIG. 2, for which the respective piston member would be furthest extended ("full out"), as is well known.

In developing the present invention, it has been determined that, with the axes 61 of the socket members 55 disposed parallel to the axis of rotation A, in accordance with the prior art, the maximum possible stroke angle of the device is fifty degrees. However, with the axes 61 at an angle of six degrees, as shown in FIG. 3, and no other changes made to the device, the stroke angle of the device could be increased to fifty-four degrees.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. An axial piston device of the bent axis type comprising a housing, a main shaft rotatably supported relative to said housing, and defining an axis of rotation, a cylinder barrel rotatably disposed within said housing, said cylinder barrel defining a plurality of mutually parallel cylinders, a piston reciprocably disposed in each cylinder for axial displacement therein, said cylinder barrel being mounted to be pivotable within said housing relative to said axis of rotation; a universal type connection operable to transmit rotational movement between said main shaft and said cylinder barrel as said cylinder barrel pivots through its range of motion between a minimum displacement and a maximum displacement relative to said axis of rotation; a plurality of connecting rods arranged to correspond generally to said cylinders, each connecting rod having a pivotable connection to one of said pistons and including a ball portion pivotably received within a socket member fixed relative to said main shaft; characterized by:

(a) each of said socket members defining an axis, each axis being oriented outwardly at an acute angle relative to said axis of rotation, thus permitting an increase in said maximum displacement of said cylinder barrel relative to said axis of rotation.

2. An axial piston device as claimed in claim 1, characterized by said main shaft including a radially extending flange portion defining a plurality of generally axial bores, each of said bores fixedly receiving one of said socket members therein.

3. An axial piston device as claimed in claim 2, characterized by each of said generally axial bores being oriented outwardly at said acute angle.

4. An axial piston device as claimed in claim 1, characterized by said acute angle being in the range of about four degrees to about eight degrees.

5. An axial piston device as claimed in claim 2, characterized by said flange portion comprising a ferrous member, and each of said socket members comprising a bronze alloy member.

6. An axial piston device as claimed in claim 1, characterized by said maximum displacement of said cylinder barrel relative to said axis of rotation is in the range of about forty-five to about sixty degrees.

7. An axial piston device as claimed in claim 1, characterized by said main shaft and said cylinder barrel cooperating to define an apex point lying in a plane, wherein each of said ball portions disposed within said socket members defines a pivot center, disposed forwardly of said plane by a distance.

* * * * *